US008145092B2

(12) United States Patent
Huang

(10) Patent No.: US 8,145,092 B2
(45) Date of Patent: Mar. 27, 2012

(54) SWITCHING MECHANISM FOR TONER CARTRIDGE

(75) Inventor: Ching-Ho Huang, Changhua County (TW)

(73) Assignee: General Plastic Industrial Co., Ltd., Taichung County (TW)

( * ) Notice: Subject to any disclaimer, the term of this patent is extended or adjusted under 35 U.S.C. 154(b) by 514 days.

(21) Appl. No.: 12/390,762

(22) Filed: Feb. 23, 2009

(65) Prior Publication Data

US 2010/0178080 A1 Jul. 15, 2010

(51) Int. Cl.
*G03G 15/08* (2006.01)

(52) U.S. Cl. ..... 399/106; 399/262; 222/DIG. 1

(58) Field of Classification Search ..... 399/262, 399/106; 222/DIG. 1
See application file for complete search history.

(56) References Cited

U.S. PATENT DOCUMENTS

| | | | | |
|---|---|---|---|---|
| 7,561,821 | B2 * | 7/2009 | Koyama et al. | 399/106 |
| 7,822,369 | B2 * | 10/2010 | Koyama | 399/262 |
| 2008/0298835 | A1 * | 12/2008 | Takashima | |
| 2010/0166460 | A1 * | 7/2010 | Maeshima | |

FOREIGN PATENT DOCUMENTS

| | | | |
|---|---|---|---|
| JP | 2005-107141 A | | 4/2005 |
| JP | 2005107141 A | * | 4/2005 |

* cited by examiner

*Primary Examiner* — David Gray
*Assistant Examiner* — Laura Roth
(74) *Attorney, Agent, or Firm* — Browdy and Neimark, PLLC

(57) ABSTRACT

A switching mechanism for a toner cartridge includes a base and a sliding member. The base is mounted to a housing. A chamber is defined between the housing and the base for receiving the sliding member. The base has a guiding slot. The sliding member has a body received in the chamber, a suspension arm extending from the body, a hook disposed on the suspension arm, and a post extending from the suspension arm and received in the guiding slot. When the sliding member is moved to different positions, an outlet of the toner cartridge can be closed or opened. The post moves along the guiding slot to cause an elastic deformation of the suspension arm for changing the position of the hook such that an erroneous operation of the switching mechanism can be avoided, and a mold for the switching mechanism is easy to manufacture to reduce the manufacturing costs.

13 Claims, 7 Drawing Sheets

SWITCHING MECHANISM FOR TONER CARTRIDGE

BACKGROUND OF THE INVENTION

1. Field of the Invention

The present invention relates generally to a toner cartridge and more specifically, to a switching mechanism for a toner cartridge that is not easy to get permanent deformation and has low manufacturing costs.

2. Description of the Related Art

Japan Patent No. 2005107141 discloses a conventional switching mechanism 40, comprising a base 60 mounted on a bottom plate 33 of a toner cartridge 30, and a sliding member 50 disposed between the base 60 and the bottom plate 33. When the toner cartridge 30 is installed in an image forming apparatus 20, the sliding member 50 is forced to move such that an outlet 511 of the toner cartridge 30 is opened. On the contrary, once the toner cartridge 30 is drawn out from the image forming apparatus 20, the sliding member 50 will be moved back to an initial position to close the outlet 511.

Because the base 60 is provided with a mating part to be cooperated with the sliding member 50 including a suspension arm 53 and a flexible arm 55, the switching mechanism 40 has the drawback of complicated structure such that a mold for the switching mechanism 40 is difficult to manufacture, resulting in high manufacturing costs. Further, the suspension arm 53 of the sliding member 50 is easy to get permanent deformed, possibly causing an erroneous operation. Therefore, it is a need to provide an improved switching mechanism for the toner cartridge.

SUMMARY OF THE INVENTION

The present invention has been accomplished in view of the above noted circumstances. It is therefore one objective of the present invention to provide a switching mechanism for a toner cartridge, which is not easy to get permanent deformation for avoiding the occurrence of the erroneous operation.

It is another objective of the present invention to provide a switching mechanism for a toner cartridge, which has a simple structure and low manufacturing costs.

To achieve these objectives of the present invention, the switching mechanism comprises a base and a sliding member. The toner cartridge having a housing and an outlet at a bottom side of the housing. The base is mounted to the housing such that a chamber is defined between the base and the housing. The base is provided with a guiding slot. The sliding member has a body received in the chamber, a suspension arm extending from the body, a hook disposed on the suspension arm, and a post extending from the suspension arm and received in the guiding slot.

When the sliding member is moved, the post of the sliding member moves along the guiding slot to cause an elastic deformation of the suspension arm for changing the position of the hook, thereby preventing the occurrence of the erroneous operation of the suspension arm of the sliding member.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
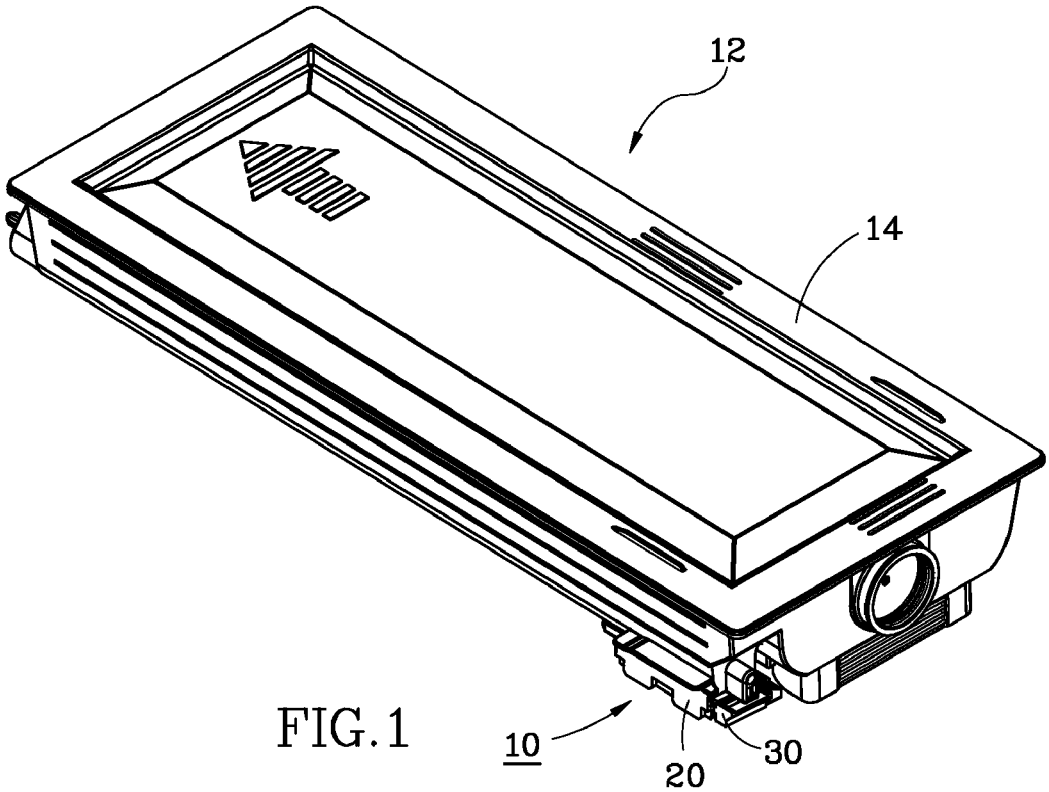
FIG. 1 is a top perspective view of a toner cartridge according to a preferred embodiment of the present invention.
Figure 2:
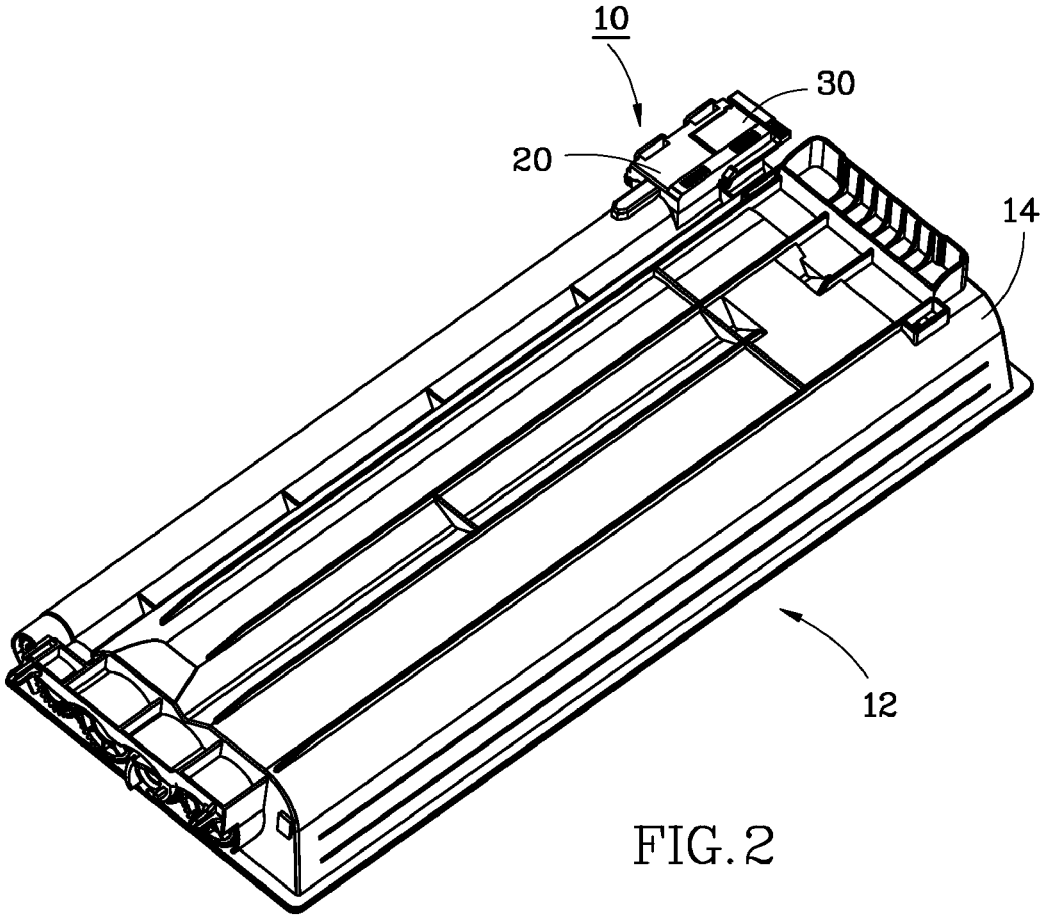
FIG. 2 is a bottom perspective view of the toner cartridge according to the preferred embodiment of the present invention.

As shown in FIGS. 1 to 4, a switching mechanism 10 for a toner cartridge 12 in accordance with the preferred embodiment of the present invention comprises a base 20 and a sliding member 30. The toner cartridge 12 includes a housing 14 and an outlet 16 at a bottom side of the housing 14.

The base 20 is mounted to the bottom side of the housing 14 such that a chamber 21, an entrance 22 and an exit 23 is defined between the base 20 and the housing 14. The bottom side of the housing 14 is provided with an opening 24 having a corresponding position with the outlet 16. Two notches 241 are provided at a periphery of the opening 24. The base 20 has a guiding slot 25 extending along a longitudinal direction X thereof, and a retaining wall 26 at the outside of the guiding slot 25. The guiding slot 25 have a high section 251, a low section 253, and an inclined section 252 connecting the high section 251 and the low section 253. Correspondingly, the retaining wall 26 have a high section 261, a low section 263, and an inclined section 262 connecting the high section 261 and the low section 263.

Figure 3:
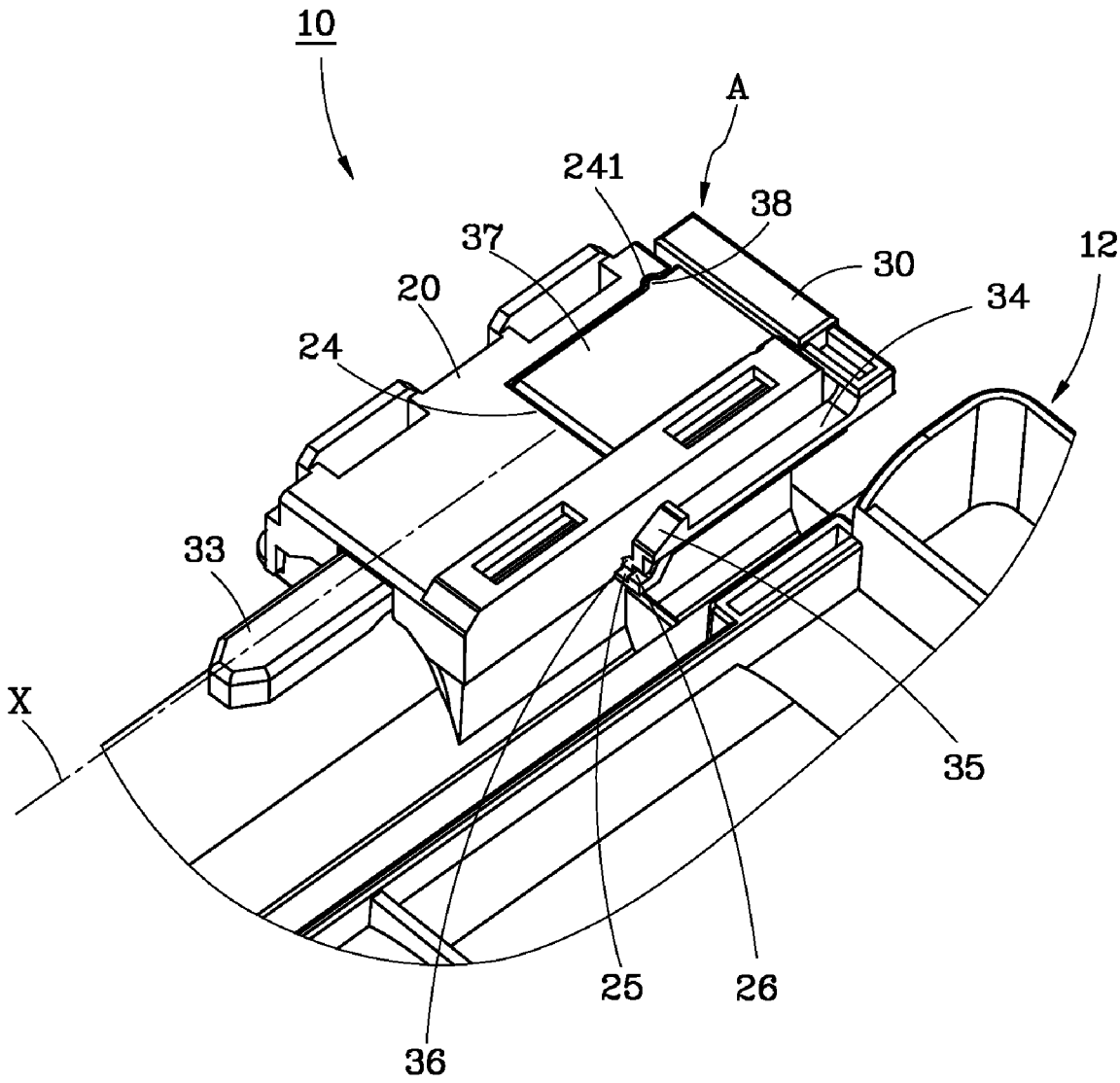
FIG. 3 is a bottom perspective view of a switching mechanism according to the preferred embodiment of the present invention.
Figure 4:
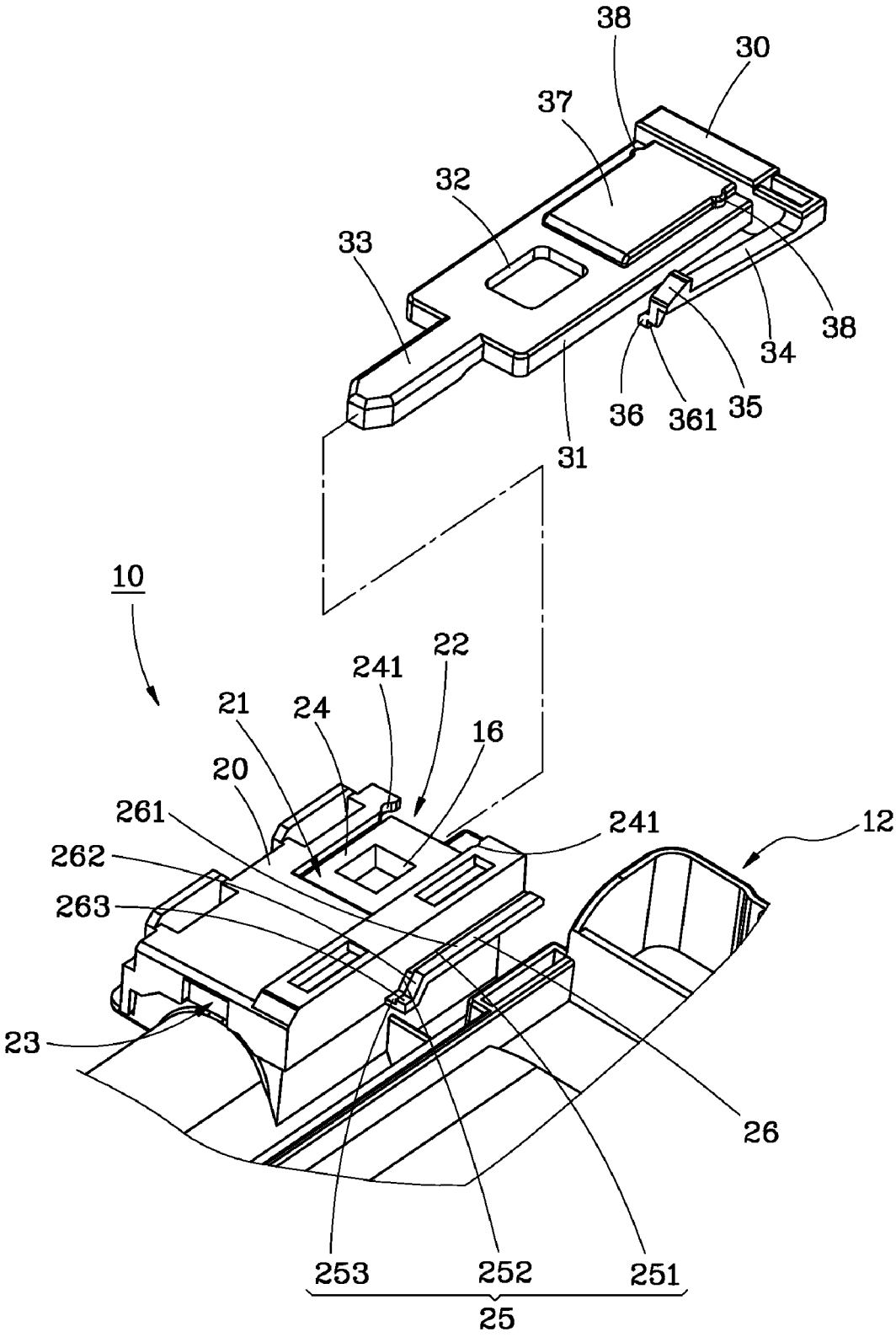
FIG. 4 is an exploded view of the switching mechanism according to the preferred embodiment of the present invention.
Figure 5:
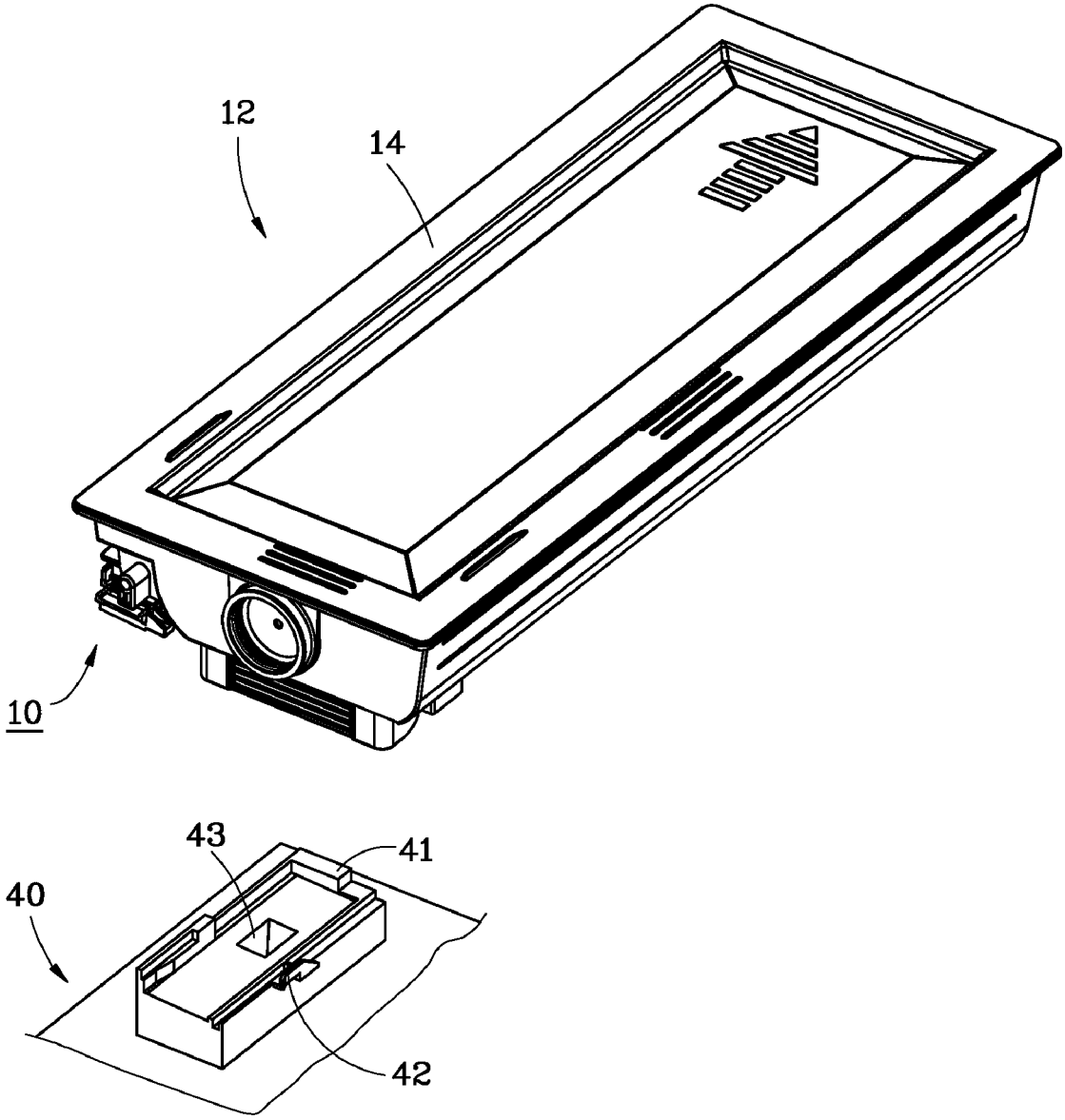
FIG. 5 is a top perspective view of the toner cartridge, showing the switching mechanism is disengaged from the mating member of the image forming apparatus.
Figure 6:
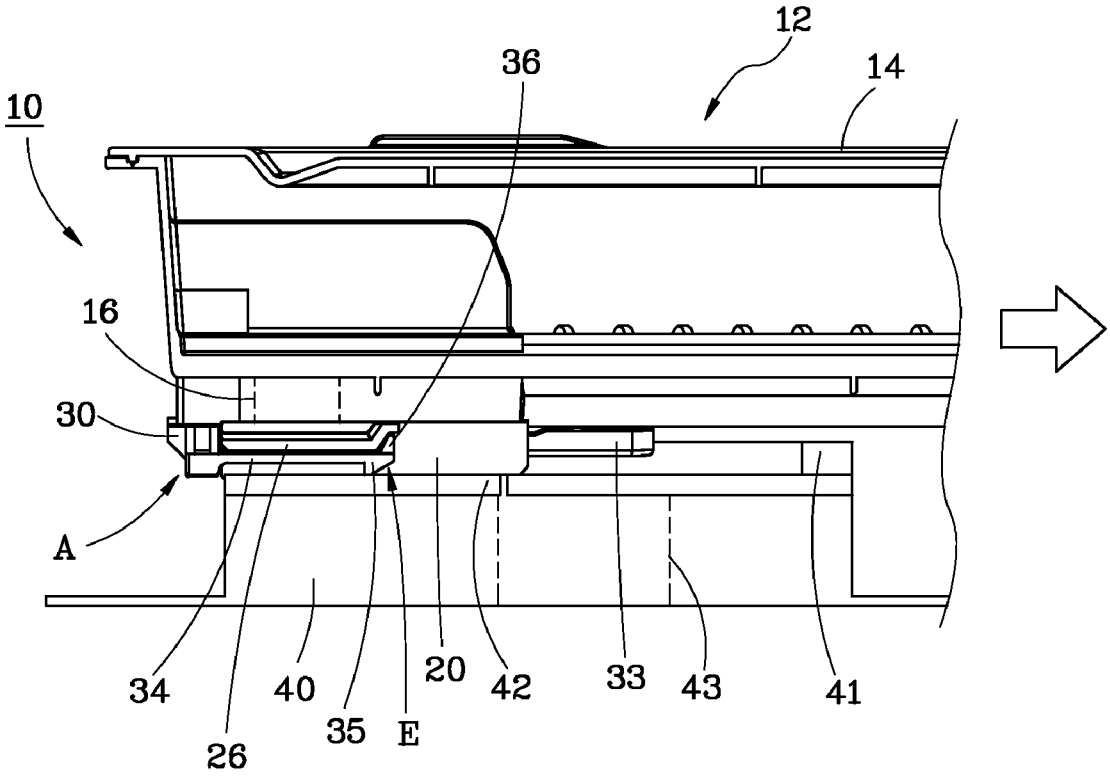
FIG. 6 is a schematic view of the switching mechanism according to the preferred embodiment of the present invention, showing the sliding member is located at the first position.
Figure 9:
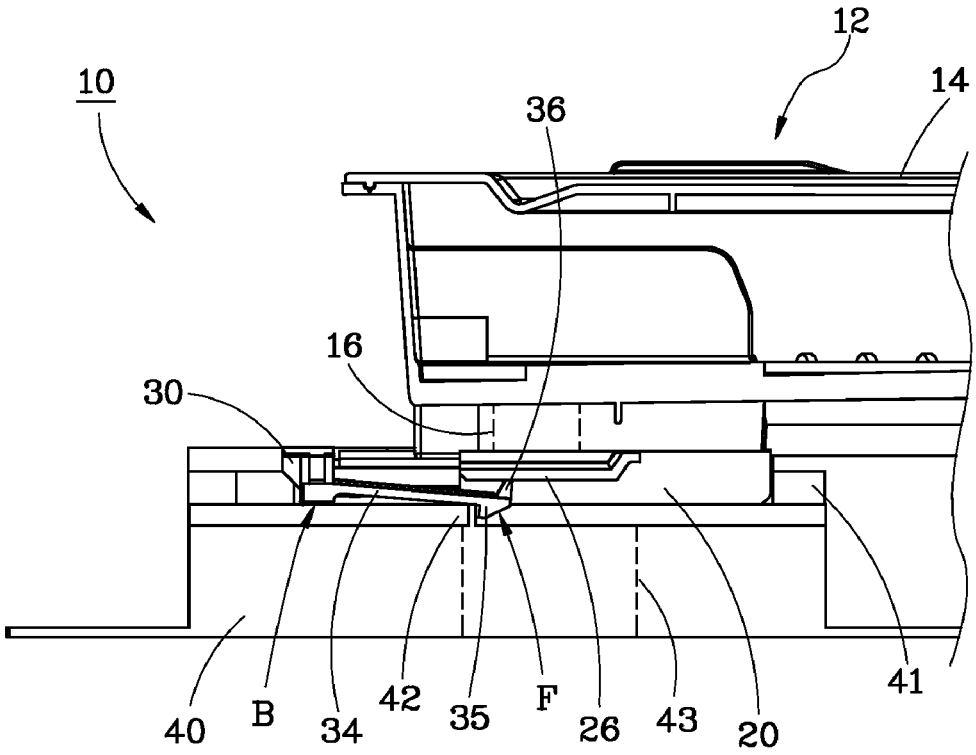
FIG. 9 is a schematic view of the switching mechanism according to the preferred embodiment of the present invention, showing the sliding member is located at the second position.

The sliding member 30 is disposed in the chamber 21 and moveable between a first position A, as shown in FIGS. 3 and 6, and a second position B, as shown in FIG. 9. The sliding member 30 has a rectangular body 31 which can be inserted into the chamber 21 through the entrance 22, a hole 32 at the body 31, a protrusion 33 extending from a tail end of the body 31 and protruding out of the base 20 through the exit 23, a suspension arm 34 extending from a front end of the body 31, a hook 35 disposed on a distal end of the suspension arm 34, a post 36 extending from the suspension arm 34 and received in the guiding slot 25 of the base 20 and provided with a recess 361 abutted against the retaining wall 26 of the base 20, a block 37 is provided on the body 31 and received in the opening 24, and two lugs 38 protruded from two opposite sides of the block 37 and engaged with the notches 241. When the sliding member 30 is moved relative to the base 20, the post 36 of the suspension arm 34 is moved along the guiding slot 25 such that the suspension arm 34 is guided by the guiding slot 25 and the retaining wall 26 to elasticaly deformed up and down. Therefore, the position of the hook 35 is changed precisely and the erroneous operation can be avoided.

As shown in FIG. 3, when the toner cartridge 12 isn't installed in an image forming apparatus (not shown), the outlet 16 is closed by the body 31 of the sliding member 30 which is located at the first position A, preventing the leakage of toner (not shown) accommodated inside the housing 14.

When installed in the image forming apparatus, the toner cartridge 12 is engaged with a mating member 40 of the image forming apparatus to make the outlet 16 open, as shown in FIGS. 5-9. The mating member 40 is provided with a block portion 41, a retaining portion 42 and an inlet 43. The fabrication processes of the toner cartridge 12 on the image forming apparatus are explained below.

As shown in FIG. 6, the toner cartridge 12 moves rightwards relative to the mating member 40, At this time, the sliding member 30 is located at the first position A where the post 36 of the sliding member 30 is located at the low section 253 of the guiding slot 25, and the hook 35 is located at an unlock portion E.

Figure 7:
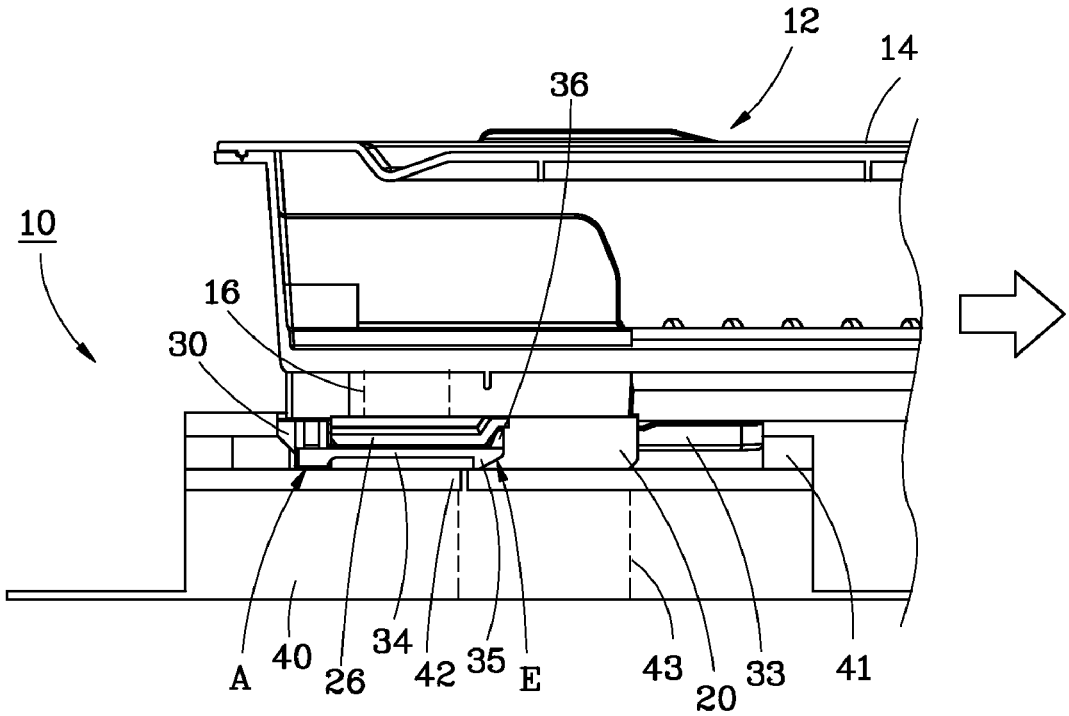
FIG. 7 is a schematic view of the switching mechanism according to the preferred embodiment of the present invention, showing the protrusion of the sliding member is stopped against the block portion of the mating member.

As shown in FIG. 7, the toner cartridge 12 is moved rightwards until the protrusion 33 of the sliding member 30 is stopped against a block portion 41 of the mating member 40. The sliding member 30 and the hook 35 are still located at the first position A and the unlock position E respectively.

Figure 8:
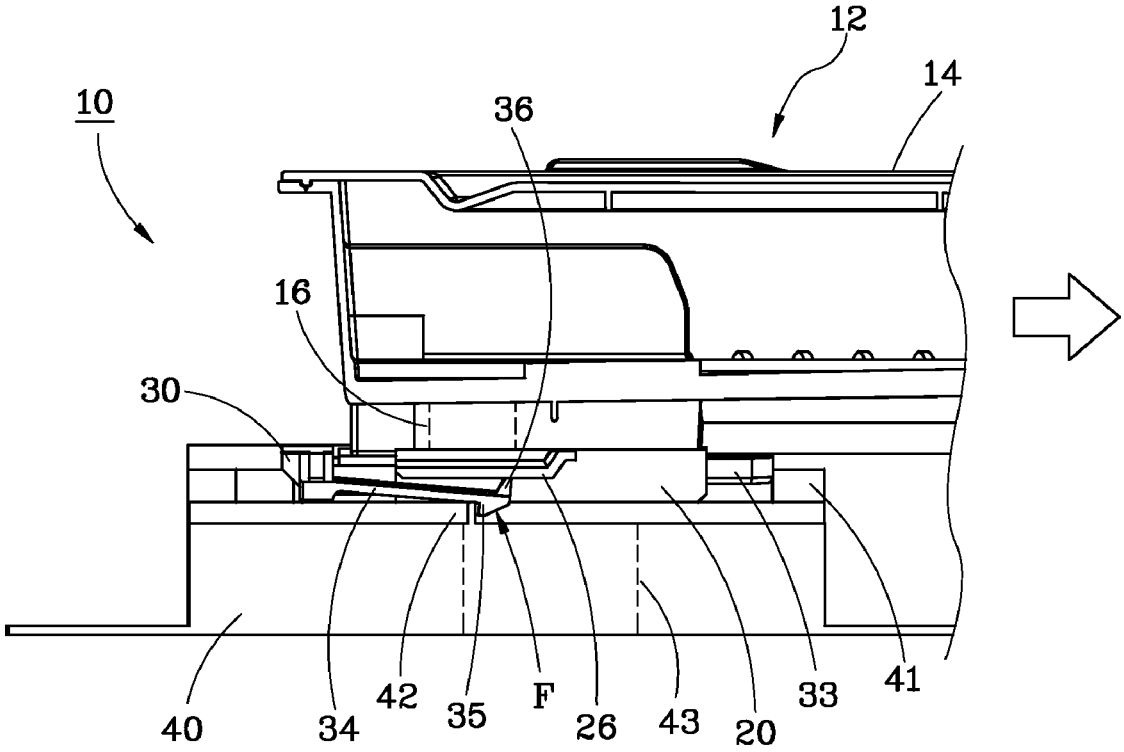
FIG. 8 is a schematic view of the switching mechanism according to the preferred embodiment of the present invention, showing the post of the sliding member is located at the high section of the guiding slot.

As shown in FIG. 8, when the toner cartridge 12 keeps moving rightwards, the base 20 is moved along with the toner cartridge 12, but the sliding member 30 stays where it is due to the obstruction of the mating member 40. For this reason, the post 36 of the sliding member 30 can arrive at the high section 251 of the guiding slot 25 through the inclined section 252 to force the suspension arm 34 of the sliding member 30 to swing clockwise, thereby causing the downward movement of the hook 35.

As shown in FIG. 9, when the toner cartridge 12 is moved to a limited position where the base 20 is contacted with the block portion 41 of the mating member 40, the protrusion 33 of the sliding member 30 is concealed into the base 20 totally. Under this circumstance, the sliding member 30 is located at the second position B where the hole 32 of the sliding member 30, the outlet 16, and the opening 24 of the base 20 are communicated with each other for allowing the toner to move from the housing 14 into the image forming apparatus through the inlet 43 of the mating member 40. Furthermore, the post 36 of the sliding member 30 is located at the high section 251 of the guiding slot 25 to keep the suspension arm 34 of the sliding member 30 biased down. The hook 35 is moved to a lock position F simultaneously. As a result, the toner cartridge 12 is assembled with the image forming apparatus.

Figure 10:
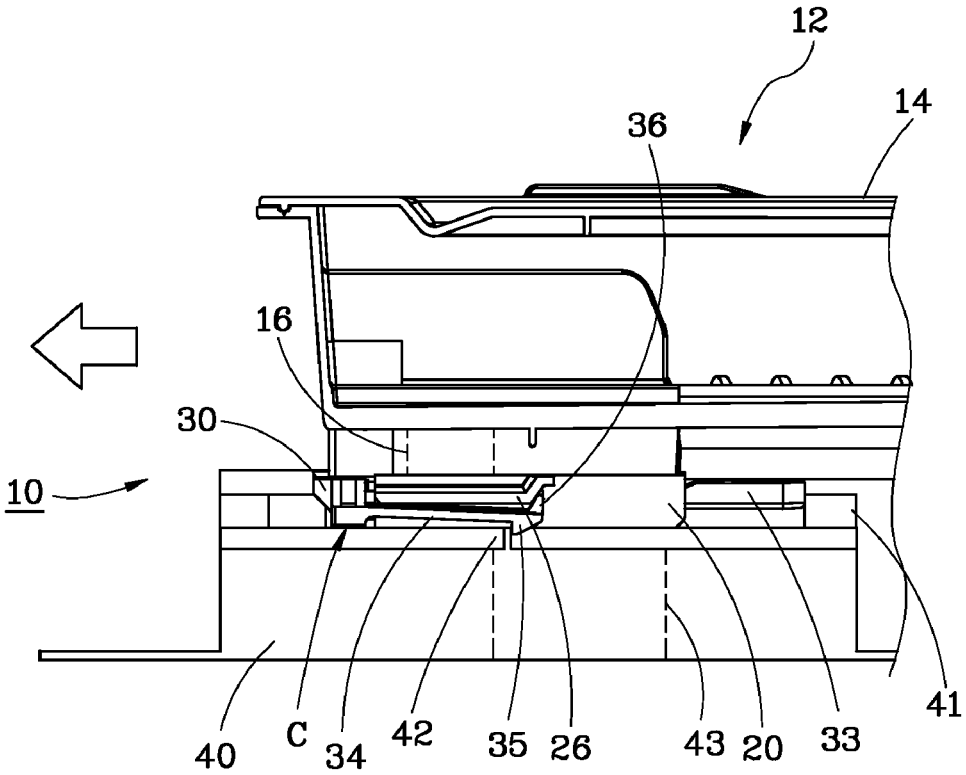
FIG. 10 is a schematic view of the switching mechanism according to the preferred embodiment of the present invention, showing the sliding member is located at the third position.

When drawing the toner cartridge 12 out of the image forming apparatus, as shown in FIG. 10, a user can pull the toner cartridge 12 leftwards. Since the hook 35 of the sliding member 30 is stopped by the retaining portion 42 of the mating member 40, the sliding member 30 is moved rightwards relative to the base 20 from the second position B to a third position C where the post 36 of the sliding member 30 is located at the inclined section 252 of the guiding slot 25. At this moment, the hook 35 is moved from the lock position F to the unlock position E because of the deformation of the suspension arm 34.

Figure 11:
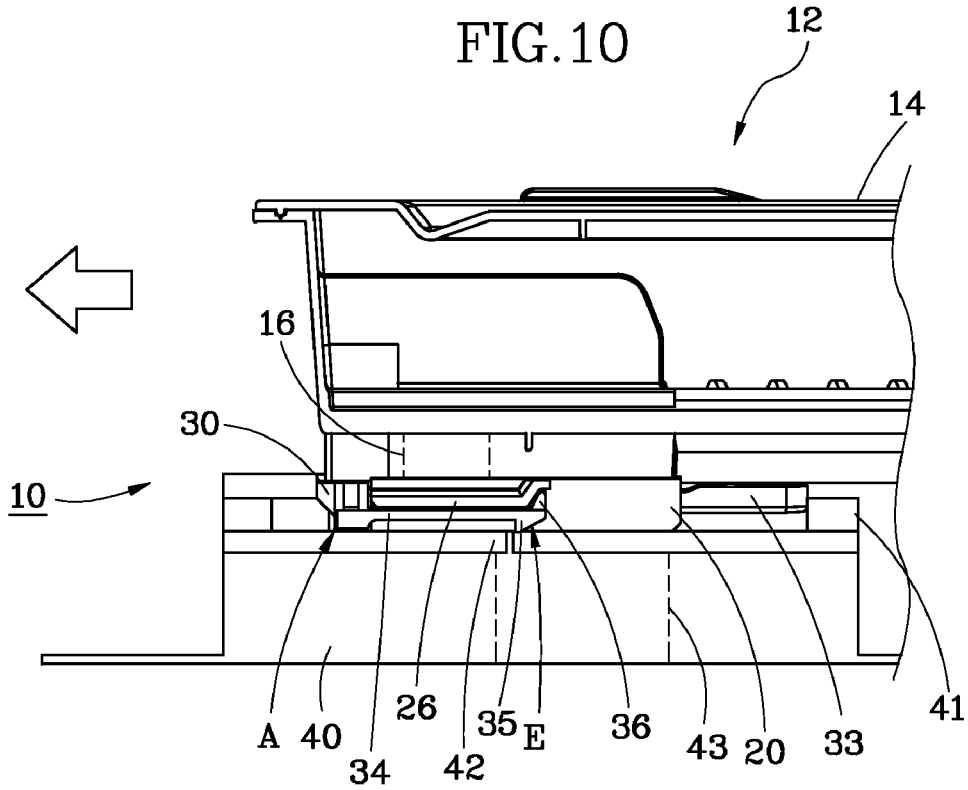
FIG. 11 is a schematic view of the switching mechanism according to the preferred embodiment of the present invention, showing the post of the sliding member is located at the low section of the guiding slot.

As shown in FIG. 11, when the toner cartridge 12 continues moving leftwards until the post 36 of the sliding member 30 reaches the low section 253 through the inclined section 252 of the guiding slot 25, the suspension arm 34 is biased up to its original position and the hook 35 is disengaged with the retaining portion 42 of the mating member 40. The hook 35 is moved back to the unlock position E and the sliding member 30 is returned to the first position A to seal the outlet 16. The lugs 38 of the sliding member 30 are engaged with the notches 241 of the base 20 to restrict the movement of the sliding member 30 relative to the base 20.

As indicated above, by means of the post 36 of the sliding member 30 that is inserted into the guiding slot 25 of the base 20, and the recess 361 of the post 36 that is abutted against the retaining wall 26 of the base 20, the suspension arm 34 of the sliding member 30 is not easy to cause an erroneous operation and get the permanent deformation generated by exceeding its elastic limit. Moreover, the base 20 and the sliding member 30 both have a simple structure such that a mold for the switching mechanism 10 of the present invention is easy to manufacture, resulting in cost reduction in manufacturing.

The switching mechanism for the toner cartridge can be made with various kinds of design on the basis of the spirit of the present invention. For example, it is unnecessary for the toner cartridge 12 to provide the outlet 16 at the bottom of the housing 14. Further, the base 20 and the sliding member 30 can be respectively provided with one or more notches 241 and lugs 38 as long as the notch 241 and the lug 38 can be matched with each other. Besides, the shapes of the base 20 and the sliding member 30 can be changeable according to the actual need. The base 20 can be mounted to the housing 14 integrally.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A switching mechanism for a toner cartridge, the toner cartridge having a housing and an outlet, the switching mechanism comprising:

a base mounted to the housing such that a chamber is defined between the base and the housing, wherein the base has an outer wall, a guiding slot defined in the outer wall and a retaining wall outside of the guiding slot; and a sliding member having a body received in the chamber, a suspension arm extending from the body, a hook disposed on the suspension arm, and a post extending from the suspension arm and received in the guiding slot;

when the sliding member is moved, the post moves along the guiding slot and the retaining wall to cause an elastic deformation of the suspension arm for changing the position of the hook.

2. The switching mechanism as claimed in claim 1, wherein the sliding member is moveable between a first position where the hook is located at an unlock position and the outlet of the toner cartridge is blocked by the body of the sliding member, and a second position where the hook is located at a lock position and the outlet of the toner cartridge is communicated with the outsides.

3. The switching mechanism as claimed in claim 2, wherein the post is located at a low section of the guiding slot of the base when the sliding member is located at the first position, and the post is located at a high section of the guiding slot of the base when the sliding member is located at the second position.

4. The switching mechanism as claimed in claim 2, wherein the hook is moved from the lock position to the unlock position through the deformation of the suspension arm when the sliding member is moved from the second position to a third position near the first position.

5. The switching mechanism as claimed in claim 4, wherein the guiding slot of the base has an inclined section between a high section and a low section, the post of the sliding member is located at the inclined section when the sliding member is located at the third position.

6. The switching mechanism as claimed in claim 1, wherein the base is mounted to the housing integrally.

7. The switching mechanism as claimed in claim 1, wherein the base has an opening having a corresponding position with the outlet.

8. The switching mechanism as claimed in claim 7, wherein the body of the sliding member includes a block received in the opening of the base.

9. The switching mechanism as claimed in claim 1, wherein the sliding member has a hole at the body.

10. The switching mechanism as claimed in claim 1, wherein the sliding member has a protrusion extending from the body and protruding out of the base.

11. The switching mechanism as claimed in claim 10, wherein the base defines with the housing an entrance for insertion of the body of the sliding member into the chamber, and an exit for protruding of the protrusion of the sliding member.

12. The switching mechanism as claimed in claim 1, wherein the body of the sliding member has a lug engaged with a notch of the base.

13. The switching mechanism as claimed in claim 1, wherein the post of the sliding member has a recess abutted against the retaining wall of the base.

* * * * *